United States Patent [19]

Ichitsubo

[11] Patent Number: 4,932,904

[45] Date of Patent: Jun. 12, 1990

[54] CONNECTOR FOR THIN CARTRIDGE

[75] Inventor: Norio Ichitsubo, Yao, Japan

[73] Assignee: Hodisen Electronics Co., Ltd., Yao, Japan

[21] Appl. No.: 330,818

[22] Filed: Mar. 30, 1989

[30] Foreign Application Priority Data

Apr. 11, 1988 [JP] Japan ..... 63-48469[U]

[51] Int. Cl.[5] ..... H01R 13/00

[52] U.S. Cl. ..... 439/630

[58] Field of Search ..... 439/629–637

[56] References Cited

U.S. PATENT DOCUMENTS 2,953,765 9/1960 Greasley ..... 439/636
3,289,148 11/1966 Antes ..... 439/637
4,026,014 5/1977 Sugimoto et al. ..... 439/634
4,367,006 1/1983 Rehbogen, Jr. et al. ..... 439/636

*Primary Examiner*—Joseph H. McGlynn
*Attorney, Agent, or Firm*—Jones, Tullar & Cooper

[57] ABSTRACT

A connector for a thin cartridge is related. The connector has a first wall which holds contact members, and a second wall of which at least a portion is connected to the first wall. Only the first wall is inserted into the frame of the cartridge. The printed circuit board mounted on the cartridge is housed between the first wall and the second wall. The contact members held by the first wall come in contact with the terminals of the thin cartridge as a result of inserting the first wall into the frame of the cartridge.

13 Claims, 6 Drawing Sheets

FIG. 10
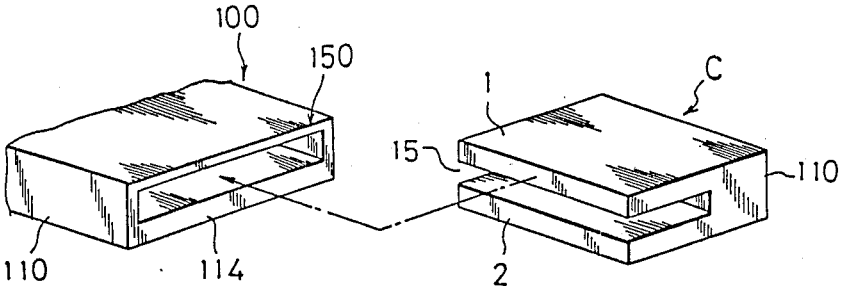
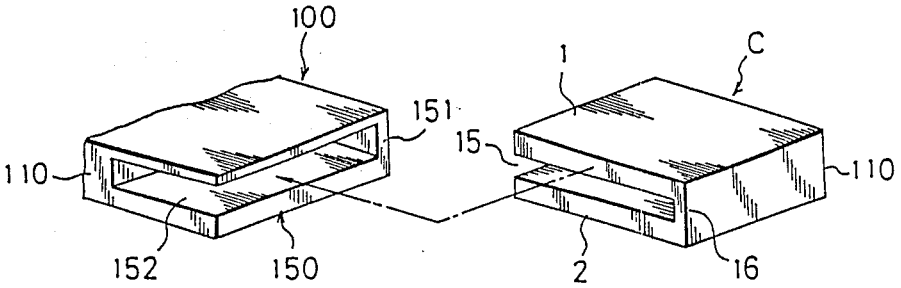
FIG. 11
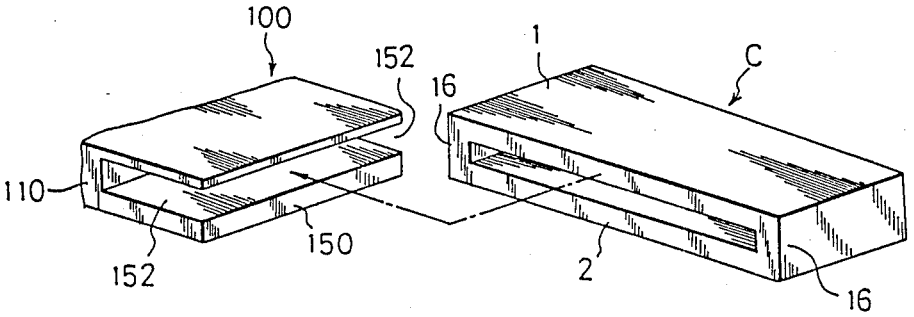
FIG. 12

CONNECTOR FOR THIN CARTRIDGE

BACKGROUND OF THE INVENTION

1. Field of the Invention

The present invention relates to a connector used for an IC memory cartridge or the like, and more particularly to a connector used for a thin cartridge.

2. Description of the Prior Art

A conventional connector of the type above-mentioned is generally arranged such that one end side of the connector having contacts is entirely inserted into the tip opening formed in the frame of a cartridge, so that the contacts are electrically connected to the terminals of the printed circuit board mounted on the cartridge frame.

In such a connector, it is required that the tip opening of the cartridge frame be greater in its longitudinal and transverse dimensions than the outer periphery of the connector. Due to this requirement, the cartridge is made thick, failing to satisfy the demand for a thinner cartridge.

On the other hand, provision may be made such that only the printed circuit board projects from the tip of the cartridge frame. In this case, it is not required to insert the entire connector into the cartridge. This is helpful to make a cartridge thin. In this case, however, the terminals arranged in a pattern on the tip surface of the printed circuit board are exposed to the outside. This eventually presents the problem of destruction of the ICs by static electricity.

SUMMARY OF THE INVENTION

In view of the foregoing, the present invention is proposed with the main object of providing a connector for a thin cartridge which may satisfy the demand for a thinner cartridge, without the need of projecting the printed circuit board from the cartridge frame such that the terminals thereof are exposed to the outside.

It is another object of the present invention to provide a connector for a thin cartridge the contact members of which accurately come in contact with the terminals of the printed circuit board mounted on the cartridge.

To achieve the objects above-mentioned, the connector for a thin cartridge in accordance with the present invention comprises:

a first wall adapted to be inserted into a space in the frame of the cartridge through an opening thereof;

a second wall of which at least a portion is connected to the first wall, the second wall being adapted to be located outside of the frame as covering the printed circuit board together with the first wall when the first wall is inserted into the space above-mentioned;

contact members held by the first wall such that the contacts of the contact members are adapted to come in contact with the terminals of the printed circuit board; and positioning means for accurately positioning the contact members and the terminals with respect to the first wall or the frame of the cartridge.

In the connector for a thin cartridge having the arrangement above-mentioned, the contacts of the contact members come in contact with the terminals in the cartridge by merely inserting the first wall into the tip opening of the frame of the thin cartridge. Accordingly, the connector may satisfy the demand for a thinner cartridge. When the cartridge is made thin in this way, it is not required to have the terminals of the printed circuit board mounted on the cartridge exposed to the outside. This reduces the possibility of the ICs mounted on the printed circuit board from being destroyed by static electricity.

According to the present invention, the thin cartridge connector is provided between the lateral side ends of the first and second walls thereof with concave relief portions which may permit the lower wall of an edge frame surrounding the opening of a cartridge to fit thereinto. Accordingly, the connector of the present invention may be used for a thin cartridge in which the lateral walls of the edge frame surrounding the opening are provided with no relief portions.

According to the present invention, the objects above-mentioned may also be achieved by an arrangement such that the first wall of the connector is fitted into a concave relief portion(s) formed in the lateral wall(s) of the edge frame surrounding the opening of the cartridge.

In the thin cartridge connector of the present invention, the positioning means for accurately positioning the contact members and the terminals with respect to the first wall or the cartridge frame may be made in the form of follower members disposed on the first wall which are fitted into guides formed in the edge frame surrounding the opening of the cartridge.

In the thin cartridge connector, the positioning means may be made in the form of a groove formed in the first wall which is fitted to a vertical rib disposed on the edge frame surrounding the opening of the cartridge.

BRIEF DESCRIPTION OF THE DRAWINGS

FIG. 10 to FIG. 12 are perspective views of modifications of the connector in accordance with the present invention, for use with a thin cartridge.

DETAILED DESCRIPTION OF THE PREFERRED EMBODIMENTS

Figure 1:
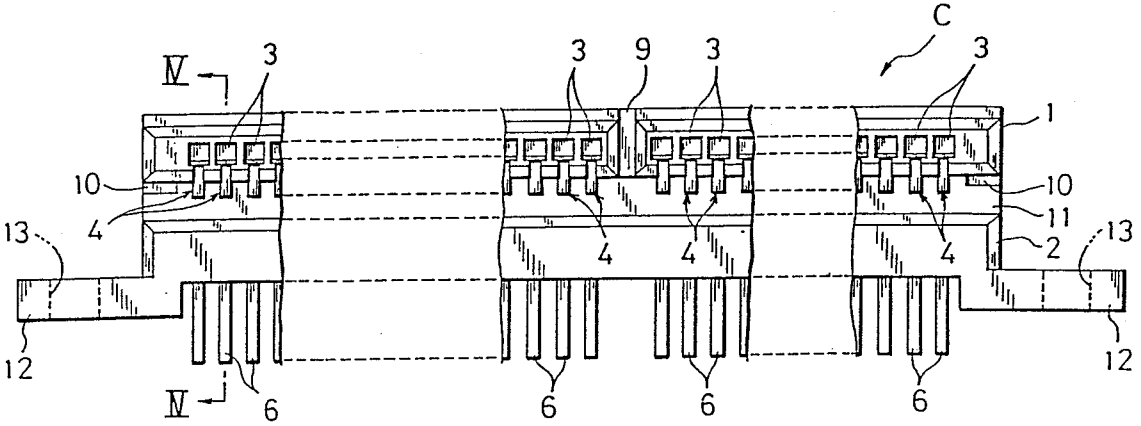
FIG. 1 is a front view, with portions omitted, of a connector in accordance with the present invention.
Figure 2:
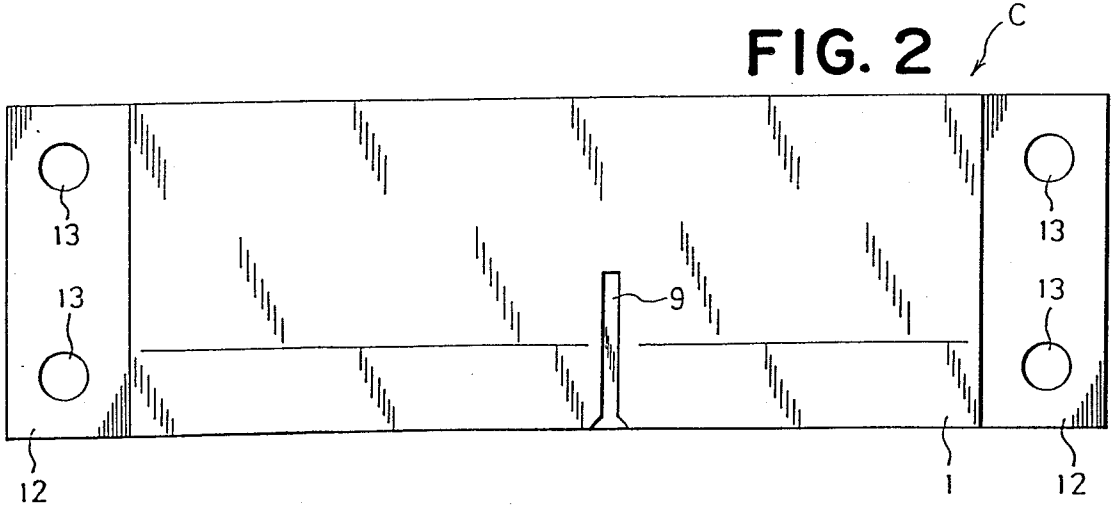
FIG. 2 is a plan view of the connector in FIG. 1.
Figure 3:
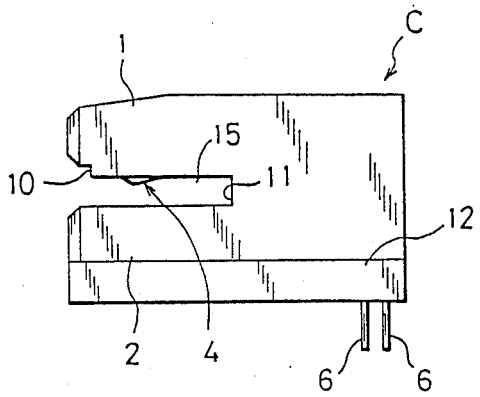
FIG. 3 is a side view of the connector in FIG. 1.
Figure 4:
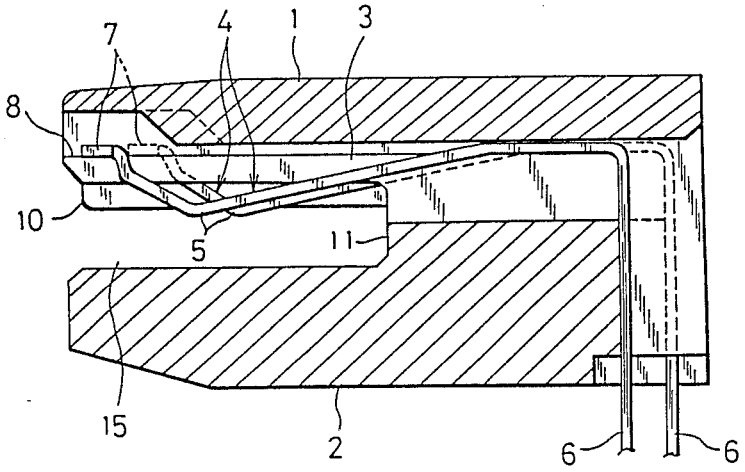
FIG. 4 is a section view taken along the line IV—IV in FIG. 1.
Figure 5:
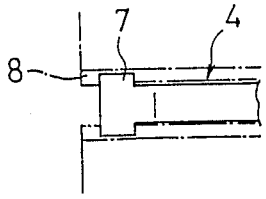
FIG. 5 is an enlarged plan view of a portion of a contact member.

A connector C shown in FIGS. 1 to 4, is provided with a first wall 1 and a second wall 2 vertically opposite to each other with a predetermined gap provided therebetween. The first and second walls 1 and 2 are formed in a unitary structure at the rear ends thereof only. Thus, relief portions 15 communicating with the gap above-mentioned are formed between the first and second walls 1 and 2 at the lateral side ends thereof.

The first wall 1 has a plurality of holding grooves 3 in a transverse direction of the wall 1, of which the sides opposite to the second wall are opened. Each of the holding grooves 3 holds a contact member 4. As shown in detail in FIG. 4, each of the contact members 4 has, in a unitary structure, a contact 5 turned in the form of a valley, a lead 6 turned substantially at right angle to the contact 5 and a hooking piece 7 disposed at the tip of the contact 5. The hooking pieces 7 are resiliently hooked on stepped portions 8 of the holding grooves 3. The leads 6 project from the lower side of the second wall 2 at the rear end thereof.

The first wall 1 is provided with a narrow groove 9 at its portion transversely eccentric with respect to the widthwise center thereof. Also, the first wall 1 is provided at the inner surfaces of the transverse ends thereof with follower members 10 projecting toward the second wall 2. The follower members 10 are in a unitary structure with the first wall 1.

The second wall 2 is provided at the inner surface thereof with a stepped standing surface 11 located in the position substantially corresponding to the position in which the rear end surface of the narrow groove 9 is located.

Also, the connector C has mounting seats 12 in which screw inserting holes 13 are formed.

Figure 6:
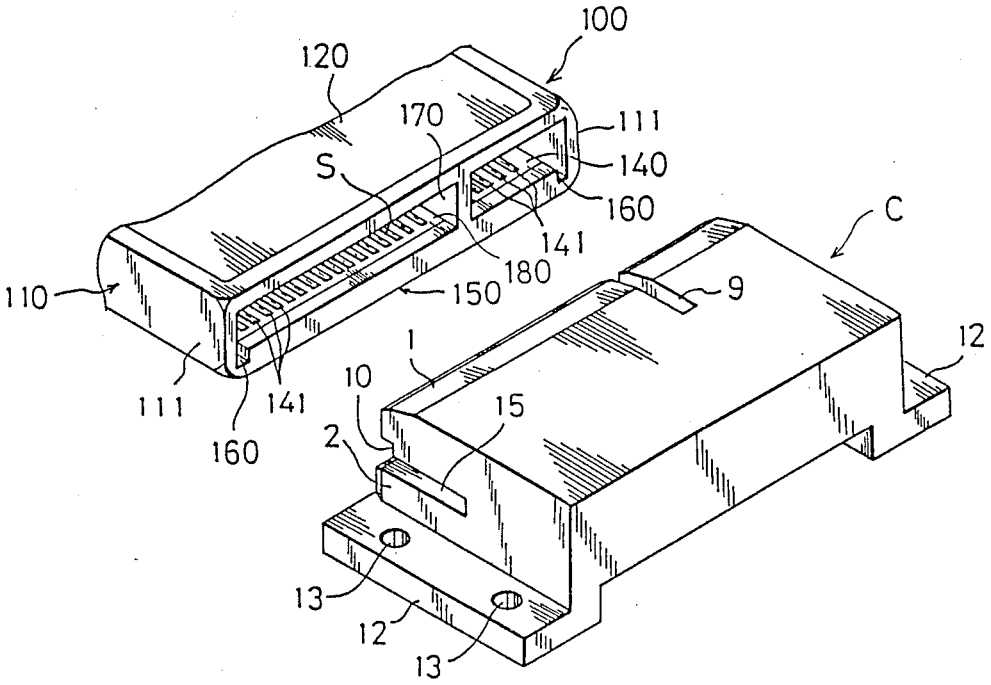
FIG. 6 is a perspective view of the connector in accordance with the present invention and a thin cartridge to which the connector is used.
Figure 7:
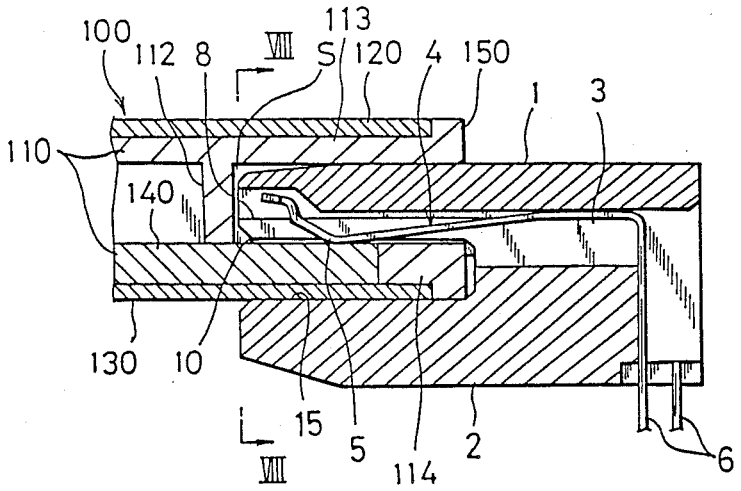
FIG. 7 is a view illustrating how to use the connector in accordance with the present invention.
Figure 8:
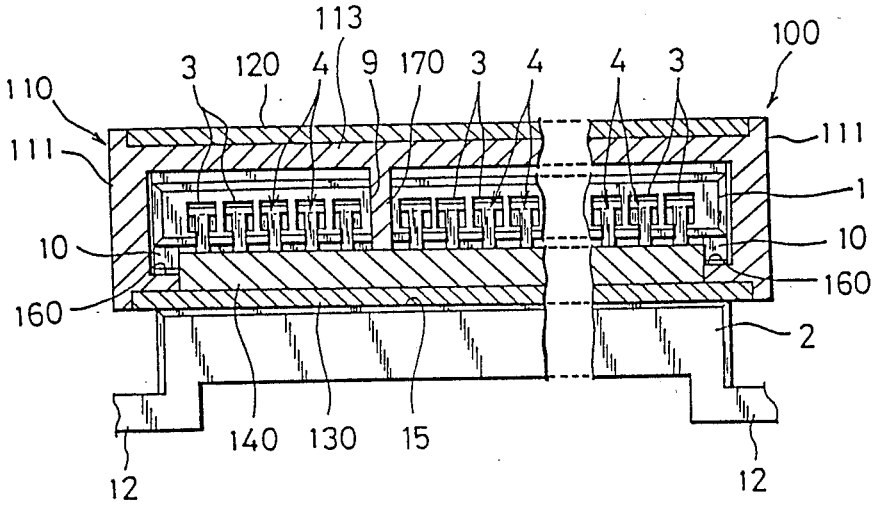
FIG. 8 is a section view taken along the line VIII—VIII in FIG. 7.

The connector C having the arrangement above-mentioned is suitably used for a thin cartridge 100 shown in FIGS. 6 to 8.

The thin cartridge 100 has a frame 110 provided with lateral walls 111 extending throughout the vertical length of the frame 110 (See FIG. 8), an upper wall 113 and a lower wall 114 (See FIG. 7). The upper opening and the lower opening of this frame 110 are closed with shield plates 120, 130, respectively. The frame 110 also has a reinforcing rib 112 which pushes down one side of a printed circuit board 140 disposed in the lower opening of the frame 110.

The thin cartridge 100 has a tip opening 180 formed by an edge frame 150 forming the tip portion of the frame 110. The edge frame 150 is provided in the inner surfaces of the lower corners thereof with groove-shape guides 160. The cartridge 100 has a vertical reinforcing rib 170 at its position transversely eccentric with respect to the center of the tip opening 180. The guides 160 are formed at the positions corresponding to the follower members 10 of the connector C such that the follower members 10 are adapted to be fitted into the guides 160. The vertical rib 170 is formed at the position opposite to the narrow groove 9 of the connector C such that the vertical rib 170 is fitted in the groove 9.

In the thin cartridge 100 having the arrangement above-mentioned, the printed circuit board 140 has a plurality of terminals 141 transversely arranged in a pattern on the tip surface thereof. Formed above the terminals 141 is a space S communicating with the opening 180. The portion of the printed circuit board 140 on which the terminals 141 are arranged, is separated, by the reinforcing rib 112, from the portion of the printed circuit board 140 on which electric elements such as ICs (not shown) are mounted. Accordingly, the reinforcing rib 112 also serves as a shield wall for preventing the entry of dust and the like into the portion on which the electric elements are mounted.

The following description will discuss the operation of the connector C applied to the cartridge 100.

When the first wall 1 of the connector C is inserted into the space S of the frame 110 through the tip opening 180 of the thin cartridge 100, the lower wall 114 of the frame 110 is fitted into the concave relief portions 15 between the lateral side ends of the first wall 1 and the second wall 2, as shown in FIGS. 7 and 8. The second wall 2 is located outside of the frame 110 such that the printed circuit board 140 is housed between the first wall 1 and the second wall 2. The contacts 5 of the contact members 4 resiliently come in contact with the terminals 141 of the printed circuit board 140, respectively, thus providing electric conduction therebetween.

When the first wall of the connector C is inserted into the space S of the thin cartridge 100, the follower members 10 are fitted into the guides 160. This enables the connector C and the cartridge 100 to be transversely positioned and aligned. Accordingly, the contact members 4 are accurately positioned with respect to the terminals 141, respectively, with high accuracy. In this particular embodiment, the lateral follower members 10 come in contact with both lateral sides of the printed circuit board 140 to directly sandwich the same. Accordingly, even though, for example, the printed circuit board 140 is positioned with respect to the frame 110 with less accuracy, the contact members 4 may be positioned with respect to the terminals 141 with high accuracy. Further, the contact members 4 of the connector C may be accurately positioned with respect to the terminals 141 of the thin cartridge 100 by the vertical rib 170 fitted into the groove 9. Such a fit between the groove 9 and the vertical rib 170 advantageously prevents, for example, the cartridge 100 from being inserted upside down or an inadequate cartridge from being inserted.

To accurately position the contact members 4 with respect to the terminals 141, there may be utilized the lateral outer sides of the first wall 1 and the lateral walls 111 of the frame 110 such that both members are fitted in each other without ricketiness.

Figure 9:
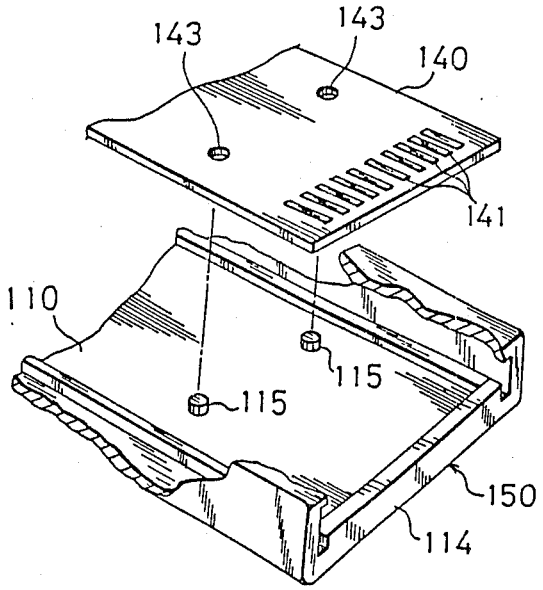
FIG. 9 is a perspective view illustrating the arrangement of positioning a printed circuit board with respect to a thin cartridge.

Alternately, the printed circuit board 140 may have a plurality of reference holes 143 at accurate positions predetermined with respect to the terminals 141, as shown in FIG. 9. Projections 115 may be formed on the frame 110 in a unitary structure therewith. In such an arrangement, the projections 115 may be fitted in the reference holes 143 such that the printed circuit board 140 is accurately positioned with respect to the frame 110. The positioning means above-mentioned may be utilized for the thin cartridge 100 having the arrangement above-mentioned, thereby accurately positioning the terminals 141 with respect to the contact members 4.

FIG. 10 schematically shows the connector C and the thin cartridge 100 above-mentioned. The connector C is provided between the lateral sides of the first wall 1 and the second wall 2 with the relief portions 15. Fitted into these relief portions 15 is the lower wall 114 of the edge frame 150 surrounding the tip opening 180 of the frame 110 of the thin cartridge 100.

According to the present invention, the relief portion 15 may be formed between only one side end of the first wall 1 and the second wall 2, and a lateral wall may be formed at the other side ends of both walls 1 and 2, as shown in FIG. 11. In such an arrangement, the thin cartridge 100 may be provided at one lateral wall of the edge frame 150 thereof with a concave relief portion 152 into which the first wall 1 is fitted.

According to the present invention, the connector C may have lateral walls 16 between the lateral side ends of the first wall 1 and the second wall 2, as shown in FIG. 12. In such an arrangement, the thin cartridge 100 may be provided at both lateral walls thereof with concave relief portions 152 into which the first wall 1 is fitted.

What is claimed is:

1. In a connector to be used for a thin cartridge in which a printed circuit board provided at the tip surface thereof with terminals arranged in a pattern is mounted in a frame of the cartridge, said frame being provided at the tip thereof with an opening, and in which a space communicating with said opening is formed above said terminals, said connector comprising:

a first wall adapted to be inserted into said space in said frame through said opening of said cartridge;

a second wall of which at least a portion is connected to said first wall, said second wall being adapted to be located outside of said frame as covering said printed circuit board together with said first wall when said first wall is inserted into said space;

contact members held by said first wall such that the contacts of said contact members are adapted to come in contact with said terminals as a result of inserting the first wall into the tip opening of the frame; and positioning means for accurately positioning said contact members and said terminals with respect to said first wall and said frame of said cartridge.

2. A connector for a thin cartridge as set forth in claim 1, wherein the first wall and the second wall are provided between the lateral side ends thereof with a concave relief portion which may permit the lower wall of an edge frame of said cartridge surrounding the opening thereof to be fitted.

3. A connector for a thin cartridge as set forth in claim 1, wherein the first wall is adapted to be fitted into a concave relief portion formed in the lateral wall portion of the edge frame surrounding the opening of the cartridge.

4. A connector for a thin cartridge as set forth in claim 1, wherein the positioning means comprises follower members disposed on the first wall which are fitted to guides formed in the edge frame surrounding the opening of the cartridge.

5. A connector for a thin cartridge as set forth in claim 2, wherein the positioning means comprises follower members disposed on the first wall which are fitted to guides formed in the edge frame surrounding the opening of the cartridge.

6. A connector for a thin cartridge as set forth in claim 3, wherein the positioning means comprises follower members disposed on the first wall which are fitted to guides formed in the edge frame surrounding the opening of the cartridge.

7. A connector for a thin cartridge as set forth in claim 1, wherein the positioning means comprises a groove formed in the first wall which is fitted to a vertical rib disposed on the edge frame surrounding the opening of the cartridge.

8. A connector for a thin cartridge as set forth in claim 2, wherein the positioning means comprises a groove formed in the first wall which is fitted to a vertical rib disposed on the edge frame surrounding the opening of the cartridge.

9. A connector for a thin cartridge as set forth in claim 3, wherein the positioning means comprises a groove formed in the first wall which is fitted to a vertical rib disposed on the edge frame surrounding the opening of the cartridge.

10. In a connector to be used for a thin cartridge in which a printed circuit board provided at the tip surface thereof with terminals arranged in a pattern is mounted in a frame of the cartridge, said frame being provided at the tip thereof with an opening, and in which a space communicating with said opening is formed above said terminals, said connector comprising:

a first wall adapted to be inserted into said space in said frame through said opening of said cartridge;

a second wall of which at least a portion is connected to said first wall, said second wall being adapted to be located outside of said frame as covering said printed circuit board together with said first wall when said first wall is inserted into said space;

contact members held by said first wall such that the contacts of said contact members are adapted to come in contact with said terminals; and positioning means for accurately positioning said contact members and said terminals with respect to said first wall and said frame of said cartridge, said positioning means comprises follower members disposed on the first wall which are fitted to guides formal in the edge frame surrounding the opening of the cartridge.

11. A connector for a thin cartridge as set forth in claim 1, wherein the first wall and the second wall are provided between the lateral side ends thereof with a concave relief portion which may permit the lower wall of an edge frame of said cartridge surrounding the opening thereof to be fitted.

12. A connector for a thin cartridge as set forth in claim 1, wherein the first wall is adapted to be fitted into a concave relief portion formed in the lateral wall portion of the edge frame surrounding the opening of the cartridge.

13. In a connector to be used for a thin cartridge in which a printed circuit board provided at the tip surface thereof with terminals arranged in a pattern is mounted in a frame of the cartridge, said frame being provided at the tip thereof with an opening, and in which a space communicating with said opening is formed above said terminals, said connector comprising:

a first wall adapted to be inserted into said space in said frame through said opening of said cartridge;

a second wall of which at least a portion is connected to said first wall, said second wall being adapted to be located outside of said frame as covering said printed circuit board together with said first wall when said first wall is inserted into said space;

contact members held by said first wall such that the contacts of said contact members are adapted to come in contact with said terminals; and positioning means for accurately positioning said contact members and said terminals with respect to said first wall and said frame of said cartridge, said positioning means comprises a groove formed in the first wall which is fitted to a vertical rib disposed on the edge frame surrounding the opening of the cartridge.

* * * * *